235-379
3/13/84 XR 4,436,182 SR

United States Patent [19]

Simonotti et al.

[11] 4,436,182

[45] Mar. 13, 1984

[54] APPARATUS FOR DEPOSITING VALUABLES IN ENVELOPES WITH AUTOMATIC ENVELOPE DISPENSING

[75] Inventors: Lucio Simonotti, Banchette d'Ivrea; Carlo Motta, Borgofranco d'Ivrea, both of Italy

[73] Assignee: Ing. C. Olivetti & C., S.p.A., Ivrea, Italy

[21] Appl. No.: 254,140

[22] Filed: Apr. 14, 1981

[30] Foreign Application Priority Data

Apr. 16, 1980 [IT] Italy ..... 67587 A/80

[51] Int. Cl.[3] ..... G07G 5/00

[52] U.S. Cl. ..... 186/37; 194/1 B; 194/DIG. 26; 232/43.2; 235/379

[58] Field of Search ..... 186/37; 194/4 C, 4 D, 194/4 E, DIG. 9, DIG. 26, 1 B; 235/379, 381; 232/15, 16, 43.2, 43.3; 109/24.1, 66

[56] References Cited

U.S. PATENT DOCUMENTS

| | | | |
|---|---|---|---|
| 3,038,157 | 6/1962 | Simjian | 194/DIG. 26 |
| 3,101,892 | 8/1963 | Reese | 232/43.3 X |
| 3,442,363 | 5/1969 | Riddle et al. | 194/DIG. 26 |
| 3,836,980 | 9/1974 | Grosswiller et al. | 109/66 X |
| 3,866,235 | 2/1975 | Maynard et al. | 194/DIG. 26 |
| 3,964,577 | 6/1976 | Bengtsson | 186/37 |
| 3,973,237 | 8/1976 | Sawaguchi et al. | 235/379 |
| 4,166,945 | 9/1979 | Inoyama et al. | 235/379 |

*Primary Examiner*—F. J. Bartuska
*Attorney, Agent, or Firm*—Schuyler, Banner, Birch, McKie & Beckett

[57] ABSTRACT

The apparatus comprises a reversible conveyor disposed between a deflection station and an access slot. The deflection station allows the dispensing of an empty envelope from a magazine 11 towards the conveyor and the deposition of an envelope containing valuables from the conveyor into a drawer. The apparatus further comprises a printing device at an intermediate position along the length of the conveyor for printing data serially on the envelope during its transfer to the drawer. This is disposed in a safe and is of the sealed type, including two motor driven rollers for inserting the envelope into the drawer. The rollers can be locked in such a way as to close the access to the drawer when the drawer is open. The apparatus is controlled by a microprocessor in two way communication with a central control unit of the apparatus.

13 Claims, 8 Drawing Figures

APPARATUS FOR DEPOSITING VALUABLES IN ENVELOPES WITH AUTOMATIC ENVELOPE DISPENSING

BACKGROUND OF THE INVENTION

The present invention relates to apparatus for the deposition of valuables in envelopes, with automatic envelope dispensing, in which the envelopes to be deposited are inserted into a slot of the apparatus and are conveyed to an internal drawer of the apparatus.

Apparatus of this type is known as one version of a night safe, in which the client deposits the valuables after having opened a door of the apparatus. There is also known deposit apparatus associated with a bank note dispenser and operable by means of the use of a credit card. In such apparatus there is usually provided a magazine for the empty envelopes and a device for withdrawing the envelopes, independently from the deposit device, so that the apparatus is complicated and costly.

SUMMARY OF THE INVENTION

The object of the invention is to integrate the withdrawing device with that for deposit, in such a way as to reduce the cost and simplify its operation. According to the invention, we now provide an apparatus for depositing valuables in envelopes of the above type, wherein the empty envelopes are contained in a magazine within the apparatus and a conveyor can be driven in a first direction to dispense an envelope from the magazine to the slot and in a second direction to convey an envelope inserted into the slot towards the drawer.

BRIEF DESCRIPTION OF THE DRAWINGS

The invention will be described in more detail, by way of example, with reference to the accompanying drawings, in which.

DESCRIPTION OF THE PREFERRED EMBODIMENT

Figure 1:
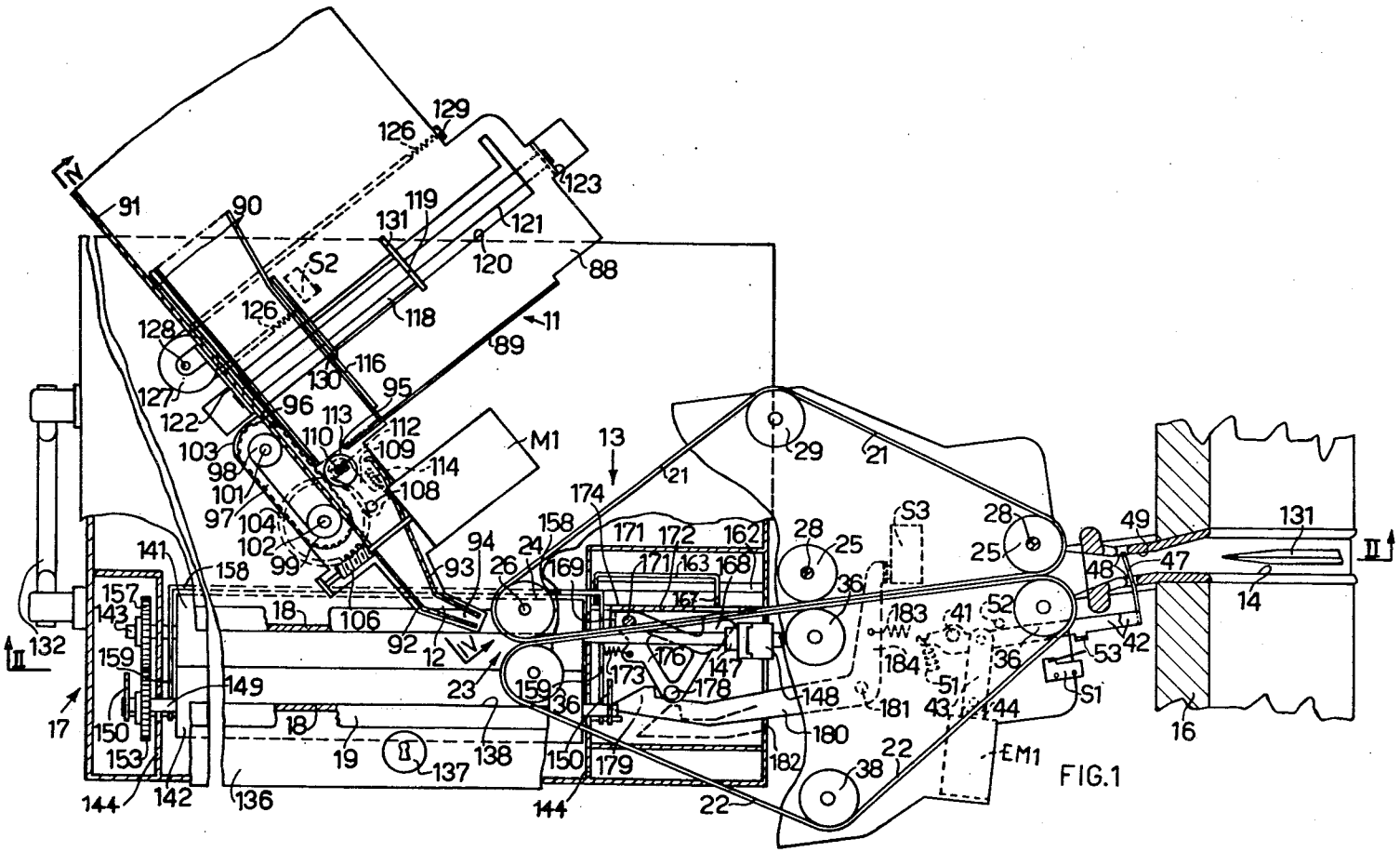
FIG. 1 is a schematic horizontal section of apparatus for depositing valuables in envelopes embodying the invention.

With reference to FIG. 1 there is generally indicated a magazine 11 for the empty envelopes, which is located within the apparatus for depositing veluables, i.e., bank notes inserted in envelopes. The magazine 11 is provided with a duct 12 for feeding a conveyor, generally indicated 13, which can convey the envelopes towards a vertical slit 14 on the front panel 16 of the apparatus. This further includes a storage drawer 17 (FIG. 2) which is connected by means of a duct 18 to a hopper 19 adjacent the conveyor 13. The apparatus is incorporated in a bank note dispenser operated by means of credit cards, which includes a central control unit for the various devices, indicated 20 in FIG. 6, a keyboard

10 for entering data and commands, and a display 9 for instructions to the client. The keyboard 10 and the display 9 are disposed on the panel 16 (FIG. 1) and are normally protected by a vandal proof roller shutter which opens automatically upon insertion of a credit card as described in the U.S. Patent application Ser. No. 227,239, filed on Jan. 22, 1981, now U.S. Pat. No. 4,359,630, entitled: "Apparatus for depositing and/or withdrawing bank-notes by means of Credit cards".

In particular, the conveyor 13 includes two pairs of belts 21 and 22 cooperating along a common path which constitutes the path of the envelope. This path lies between the slit 14 and an internal deflection station indicated 23 adjacent the duct 12 of the magazine 11 and the hopper 19.

Figure 2:
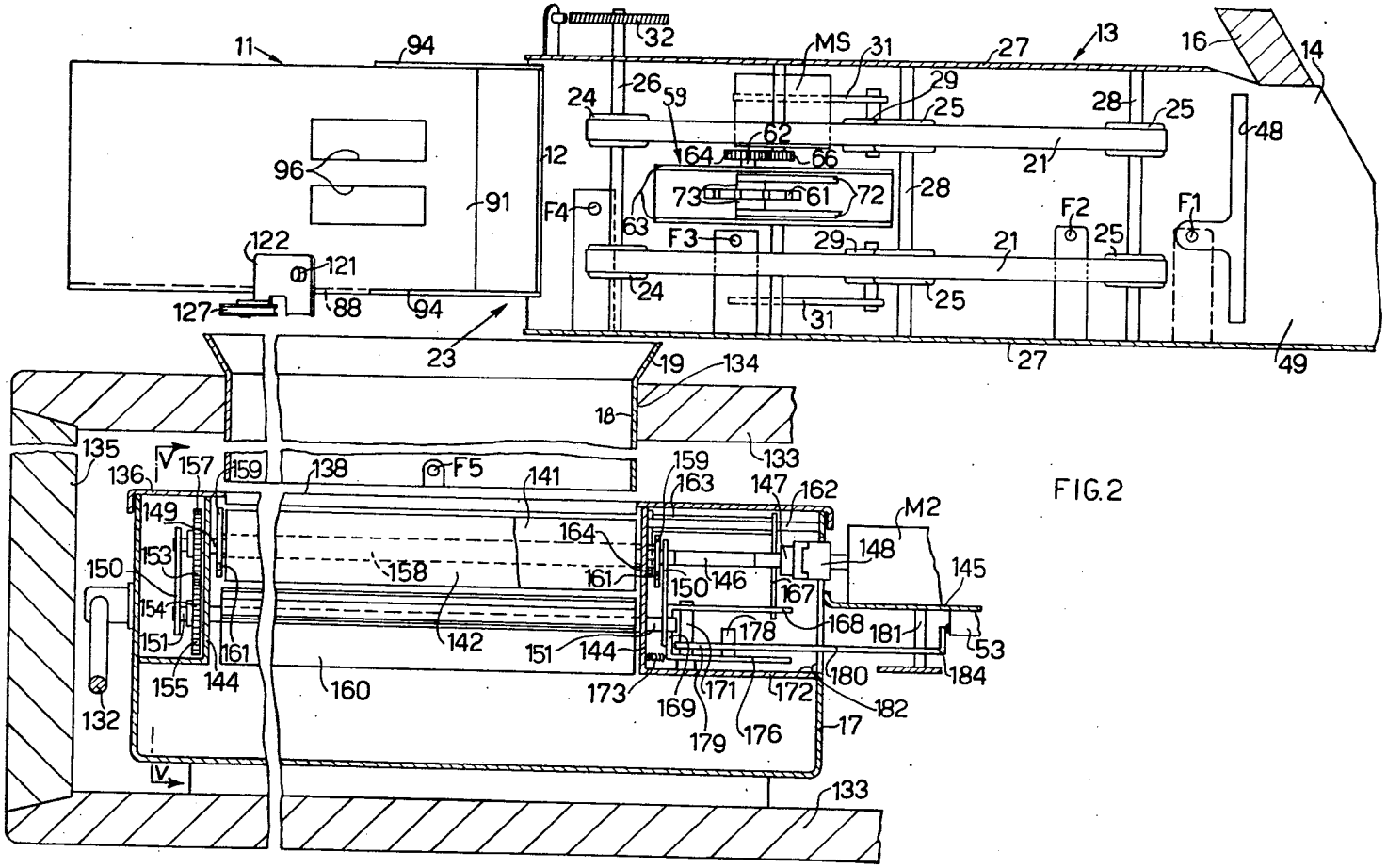
FIG. 2 is a section taken on the line II—II of FIG. 1.

The two belts 21 are driving belts, and pass over two corresponding sets of pulleys 24 and 25 (FIGS. 1 and 2). The pulleys 24 are fixed on a shaft 26 rotatable on the framework 27 of the apparatus. The pulleys 25 are, on the other hand, freely rotatable on corresponding shafts 28 fixed on the framework 27. For each belt 21 there is, moreover, provided a belt-tensioner pulley 29 (FIG. 3) carried by a resiliently biased lever 31. On the shaft 26 there is fixed a worm wheel 32 in engagement with a worm screw 33 which is driven to rotate by a reversible electric motor MR.

The belts 22 are driven belts and pass over two corresponding series of pulleys 36 each of which is carried by a resiliently biased lever 37 in such a way as to urge the belts 22 towards the belts 21 adapting itself to the thickness of the envelope in transit. For each belt 22 there is moreover provided a belt-tensioner pulley 38 carried by a resiliently biased lever 39.

On a fixed axis 41, on which the resiliently biased levers 37 of the pulleys 36 adjacent the slit 14 are pivoted, there is also pivoted a bridge 42 (FIG. 1) connected by means of a link 43 to a core 44 of a pull-in solenoid EM1. The bridge 42 is provided with a crosspiece 47 which is normally engaged in an opening 48 in a duct 49 extending between the slit 14 of the panel 16 and the two pairs of pulleys 25,36. A spring 51 normally holds the lever 42 in contact with a fixed stop 52 in such a way that the duct 49 is closed by the crosspiece 47. The bridge 42 is further provided with a tab 53 which can engage a switch S1 for indicating the occurrence of operation of the solenoid EM1.

Along the path of the envelopes there are provided four photoelectric cells, F1,F2,F3 and F4 (FIG. 3) which identify a corresponding number of positions of the envelope. In correspondence with the photoelectric cells F3, between the two pairs of belts 21 and 22 (FIG. 3) there is located an envelope printer or stamping device, generally indicated 59. This device includes a character wheel 61 which carries 16 characters comprising the ten numbers 0–9 and several symbols. The wheel 61 is fixed on a shaft 62 which is rotatable on the fixed frame 63 of the printer 59. The wheel 61 carries a synchronisation element 56, for example a magnetised insert, which can cooperate with a sensor 57 to synchronise the rotation of the wheel 61 with the central unit 20. On the shaft 62 there is also fixed a toothed wheel 64 in engagement with a pinion 66 fixed on the shaft of a stepping motor MS which can selectively drive the wheel 61 to rotate to carry the characters to be printed from time to time into correspondence with the printing position 67. An inking wheel 68 cooperates with the wheel 61, the inking wheel being engaged in a recess 69 in the arms of a bridge 70 which is resiliently urged in an anti-clockwise sense, holding the wheel 68 in contact with the wheel 61. It is possible to remove and replace the wheel 68 by acting manually on the bridge 70.

On a fixed pin 71 there is pivoted a bridge 72 carrying two rollers 73 in correspondence with the printing point 67. On the bridge 72 there is further fixed a core 74 of an electromagnet EM2. The bridge 72 is normally held by a large spring 77 in contact against a fixed but adjustable stop consituted by an eccentric 78. In this position the rollers 73 hold an envelope passing the wheel 61 spaced from this thereby avoiding any printing. With the rollers 73 there cooperates a pressure roller 79 carried by a lever 81 pivoted on a fixed pin 82 and urged in a clockwise sense by a spring 83 over which the spring 77 prevails. A link 84 pivoted on the lever 81 is connected by a pin and slot coupling to the core 86 of another solenoid EM3.

Figure 4:
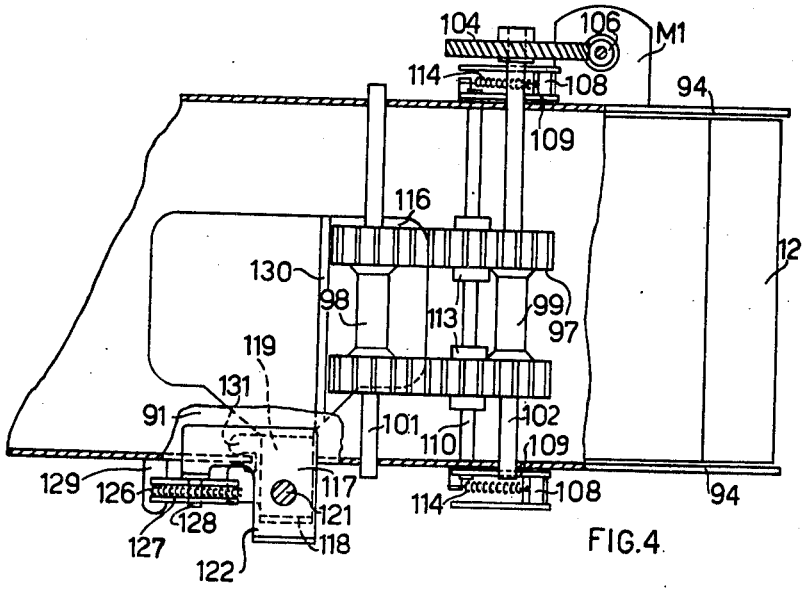
FIG. 4 is a section taken on the line IV—IV of FIG. 1.

The magazine 11 (FIG. 1) is constituted by a fixed horizontal plate 88 having a front edge 89 bent up in such a way as to retain the stack of empty envelopes 90. Onto the plate 88 there is welded a side wall 91 against which abuts the first envelope 90 to be withdrawn. The side wall 91 has an extension portion 92 which constitutes a side wall of the duct 12. This includes another side wall 93 connected to the side wall 92 by two plates 94. The edge 89 has a lateral interruption 95 to allow the passage of envelopes 90 from the magazine 11 into the duct 12. The side wall 91 is provided with two openings 96 (FIG. 4) extending partly in correspondence with the magazine 11 and partly in correspondence with the duct 12, in which openings there is lodged an envelope feed device comprising two externally toothed belts 97. These belts pass over two pairs of pulleys 98 and 99 (FIG. 1) fixed on two vertical shafts 101 and 102 each rotatable on two extensions 103 of the plates 94. On the shaft 102 there is also fixed a worm wheel 104 in engagement with a worm screw 106 fixed to the shaft of an electric motor M1. On two pins 108 fixed to the plates 94 (see also FIG. 4) there are pivoted two arms 109 connected to a shaft 110 passing through two slots 112 of the plates 94. On the shaft 110 there are fixed two rollers 113 of material having a high coefficient of friction, which are held against the belts 97 by the action of two springs 114 (FIG. 1).

The envelopes 90 are held pressed against the side wall 91 by a plate 116 (FIG. 1) a part 117 of which is connected by means of a crosspiece 118 to an arm 119. The crosspiece 118 is inserted in an aperture 120 of the plate 88, which acts as a guide, whilst the part 117 and the arm 119 are slidable on a spindle 121 (FIG. 4) fixed on a plate 122 secured to the plate 91 and a bent up tab 123 of the plate 88. On another extension 124 of the plate 116 there is fixed one end of a spring 126 which passes around a pulley 127 rotatable on a fixed axle 128 and is connected to a tab 129 of the plate 88. The spring 126 thus presses the plate 116 toward the plate 91 thereby pressing against the envelope 90. A fold 130 of the plate 116 allows the pressure to be concentrated on that portion of the envelopes in contact with the belts 97. A projection 131 of the arm 119 is operable, when at the end of its path, to act on a switch S2 to indicate to the central unit 20, or to the operator by means of the screen 9 (FIG. 6) that the magazine 11 (FIG. 1) is empty of envelopes 90.

Figure 5:
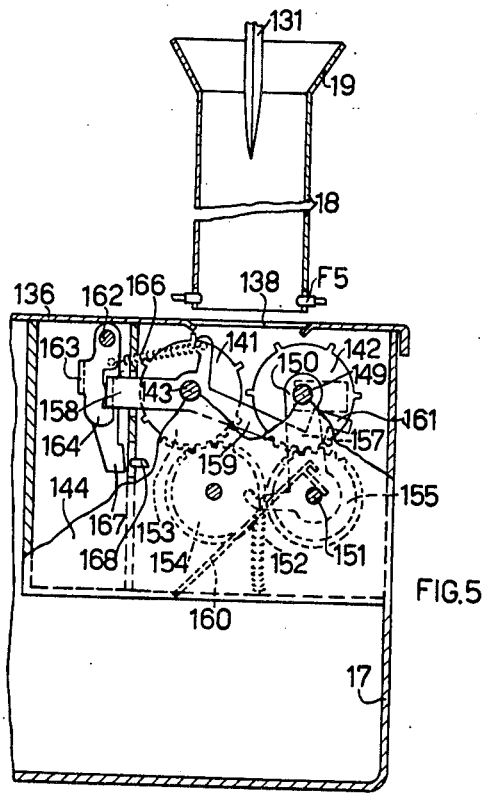
FIG. 5 is a partial section taken on the line V—V of FIG. 2.

The drawer 17 (FIG. 2) is located within a safe 133 having a passage 134 for the duct 18 and is accessable through the usual door 135 of the safe 133. The drawer 17 is of the removable type, provided with a handle 132 and is, moreover, of the sealed type, that is to say able to prevent the removal of the envelopes, for example during transport from the safe 133. For this purpose the drawer 17 is provided with a cover 136 (FIG. 1) openable by authorised personnel by means of a key and lock 137. The cover is provided with an aperture 138, normally located under the duct 18 to receive full envelopes 131. The aperture 138 is however closed by a pair of grooved rollers 141 and 142 (FIG. 5). In particular, the roller 141 is fixed on a shaft 143 rotatable in two plates 144 (FIG. 2) fixed to the drawer 17. An extension 146 of the shaft 143 carries a toothed ring 147 which is normally in engagement with a similar ring 148 carried by the shaft of an electric motor M2 mounted on a bracket 145 fixed in the safe 133 outside the drawer 17. The duct 18 (FIG. 5) carries a photoelectric cell F5 at its lower end, operable to indicate the arrival of an envelope 131.

The roller 142 is fixed onto a shaft 149 rotatably carried by two arms 150 pivoted on a fixed axle 151 and urged in an anti-clockwise direction by two springs 152. On the shaft 143 there is fixed a gear 153 in engagement via a freely rotatable toothed wheel 154 with another toothed wheel 155 rotatable on the shaft 151. On the shaft 149 there is fixed a gear 157 identical to the gear 153 and in engagement with the toothed wheel 155, so that the two rollers 141 and 142 are positively rotated in the opposite senses, independently of the frictional drag of the envelope. A plate 160 is fixed on the shaft 151 and serves to deflect the incoming envelopes in such a way that they are arranged horizontally in the drawer 17. On the shaft 143 there is pivoted a bridge 158 having two arms 159 (FIG. 5) provided with a hook projection 161 which is able to cooperate with the shaft 149. On another fixed shaft 162 there is pivoted a bridge 163 having a hook arm 164 normally in engagement with the crosspiece of the bridge 158. A spring 166 stretched between the bridge 158 and the bridge 163 normally holds the bridge 158 hooked up in the position of FIG. 5 so that the projections 161 do not influence the shaft 149.

Another arm 167 of the bridge 163 can cooperate with a projection 168 of a bridge 169 (FIG. 1) pivoted on a vertical pin 171 fixed onto a bracket 172 secured to the side wall of the drawer 17. The bridge 169 is normally held, by a spring 173, abutting against a fixed stop 174. An arm 176 of the bridge 169 is provided with a pin 178 cooperating with a hook end 179 of a lever 180 pivoted on a pin 181 fixed to the bracket 145 which carries the motor M2. The lever 180 enters a niche 182 of the side wall of the drawer 17 in which the bridge 169 is located. The spring 183 holds an arm 184 of the lever 180 in contact with a switch S3.

For the control of the operations of the apparatus described there is provided a microprocessor 186 (FIG. 6) for example an 8 bit microprocessor of the type commercially available under the name "INTEL 8035", which is connected by a serial interface 187 to the control unit 20. It is also connected, through a multiple channel 188 and an input/output interface 189, to an encoder unit 191 for the signals received from the sensor 57, the switches S1–S3 and the photocells F1–F5, to allow the unit 191 to transmit them to the microprocessor 186. The unit 189 is also connected to a driver unit 192 for the electromagnets EM1–EM3 and the motors M1,M2,MS-MR. Because this latter is of the reversible type, in FIG. 6 there has been indicated an envelope outputting control circuit MRU, which controls rotation in the sense such as to dispense an envelope, and a deposition control circuit MRD which controls rotation in the opposite sense.

The operation of the apparatus will now be described with the aid of the flow diagrams of FIGS. 7 and 8.

Figure 6:
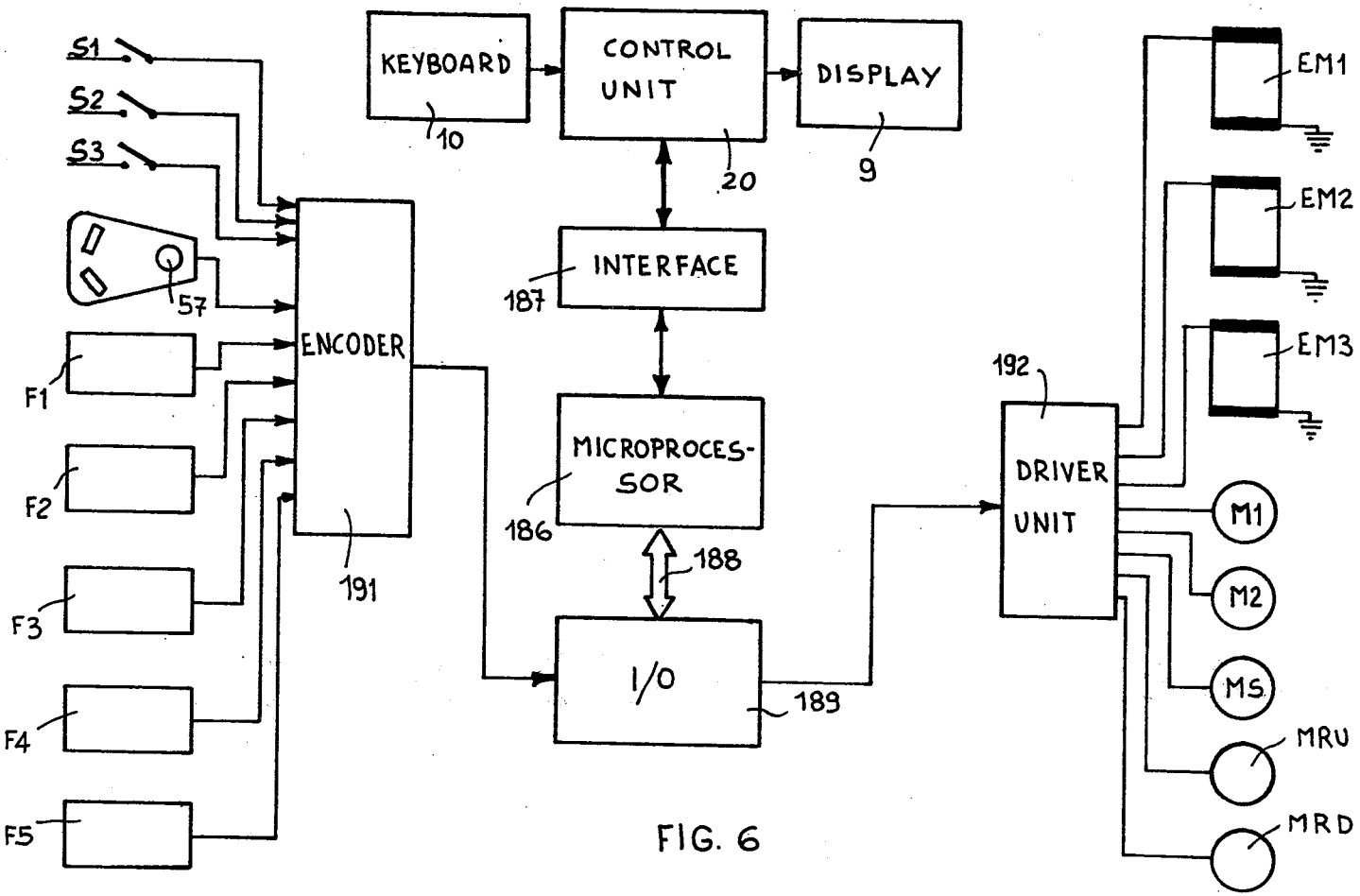
FIG. 6 is a block schematic diagram of the electronic control of the apparatus.

Initially, the operator inserts his credit card into the apparatus and the validity of this is checked by the control unit 20 (FIG. 6). Then the operator enters on the keyboard 10 the operation to be performed, which for this apparatus can be a request for an envelope or to deposit an envelope. In fact the operator can make a deposit in his own envelope, the dimensions of which can vary within certain limits, or else can effect deposition in an envelope requested from the apparatus.

Supposing that the operator requests, by means of the keyboard, an envelope 90 (FIG. 1), the central unit 20 (FIG. 6) sends a message to the microprocessor 186 making it recall from its ROM an envelope dispensing programme. First, by means of the unit 191 it polls the switch S2 (operation indicated 193 in FIG. 7). If the switch S2 is engaged by the projection 131 because the envelopes 90 are exhausted, this is closed and the microprocessor 186 (FIG. 6) communicates the condition to the control unit 20 which informs the operator. If, on the other hand, S2 is open the microprocessor 186, by means of the interface 189 and the unit 192, puts the motor M1 of the envelope magazine 11 (FIG. 1) into rotation, whilst the reversible motor MR of the conveyor 13 (FIG. 3) is put into rotation via the output circuit MRU (FIG. 6). These two operations are indicated 194 in FIG. 7. Subsequently the microprocessor 186 (FIG. 6) fixes a time limit or time out (T.O.), for example 100 seconds, within which the operation must be completed (operation 196 in FIG. 7).

The motor M1 (FIG. 1), via the worm screw 106 and the worm wheel 104, causes the shaft 102 to rotate together with the pulleys 99 and the belts 97. Therefore, the lowermost envelope 90 in FIG. 1 is urged towards the duct 12, whilst the others are retained by the fixed rollers 113. The envelope 90 thus becomes engaged between the two pairs of belts 21 and 22 (FIG. 3) which are already in movement under the action of the motor MR, by means of the screw 33, the wheel 32 and the pulleys 24,25,36.

Figure 7:
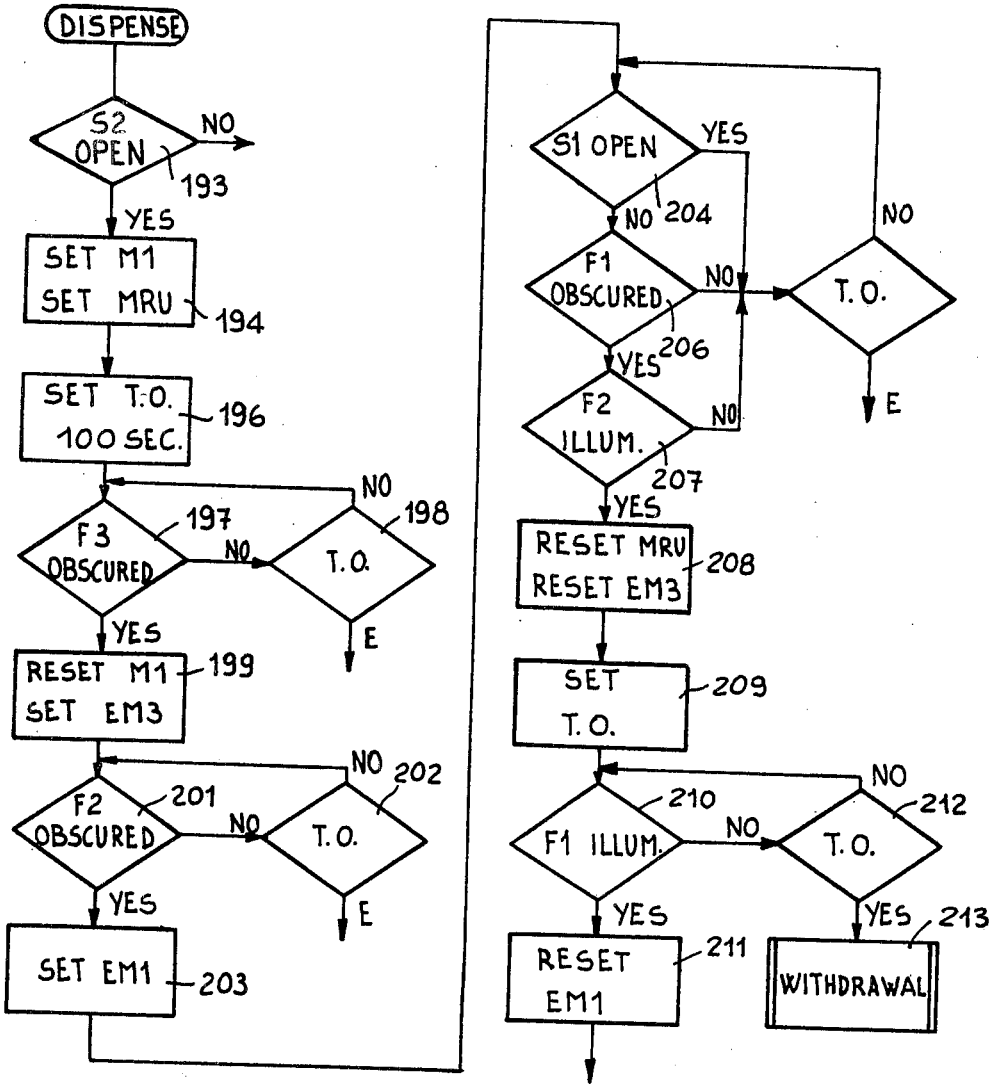
FIGS. 7 and 8 are two flow diagrams illustrating the operation of the apparatus.
Figure 8:
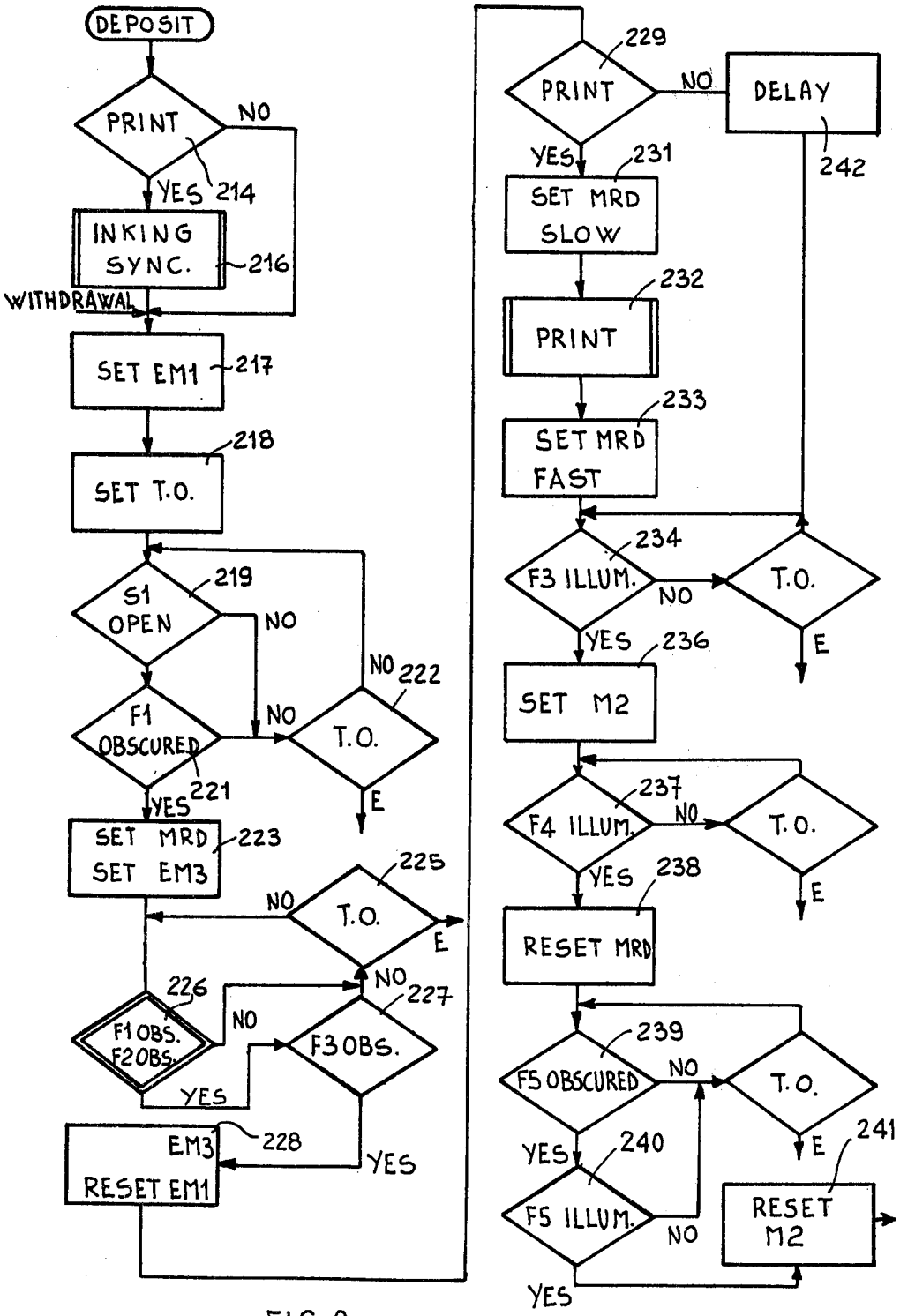

Meanwhile the microprocessor 186 (FIG. 6) polls the photocell F3 in a polling operation 197 (FIG. 7). As long as this is not obscured and a subsequent time out poll 198 gives a negative result, the poll 197 is repeated. If on the other hand the poll 198 gives a positive result a signal E is given which indicates an obstruction of the apparatus, so that the microprocessor 186 closes down the apparatus and resets all the controls. When the poll 197 gives a positive result the microprocessor 186 (FIG. 6) stops the motor M1 and causes energization of the electromagnet EM3 (operation 199 in FIG. 7). This now causes the lever 81 (FIG. 3) to rotate thereby separating the roller 79 from the rollers 73, thus opening the path for the envelope 90 and avoiding jamming of it between the rollers 73 and 79. The microprocessor 186 now carries out a poll 201 (FIG. 7) of the photocell F2. If the envelope 90 (FIG. 3) has not reached this photocell, the poll 201 is repeated after a time out poll 202 similar to the poll 198. When, on the other hand, the envelope 90 covers the photocell F2, the microprocessor 186 causes energization of the electromagnet EM1 (operation 203). This then causes the bridge 42 (FIG. 1) to rotate and frees the duct 49 of the crosspiece 47, thus opening the path of the envelope towards the slot 14. The tab 53 of the bridge 42 now closes the contact S1 which signals to the microprocessor 186 (FIG. 6) the occurrence of this opening.

Figure 3:
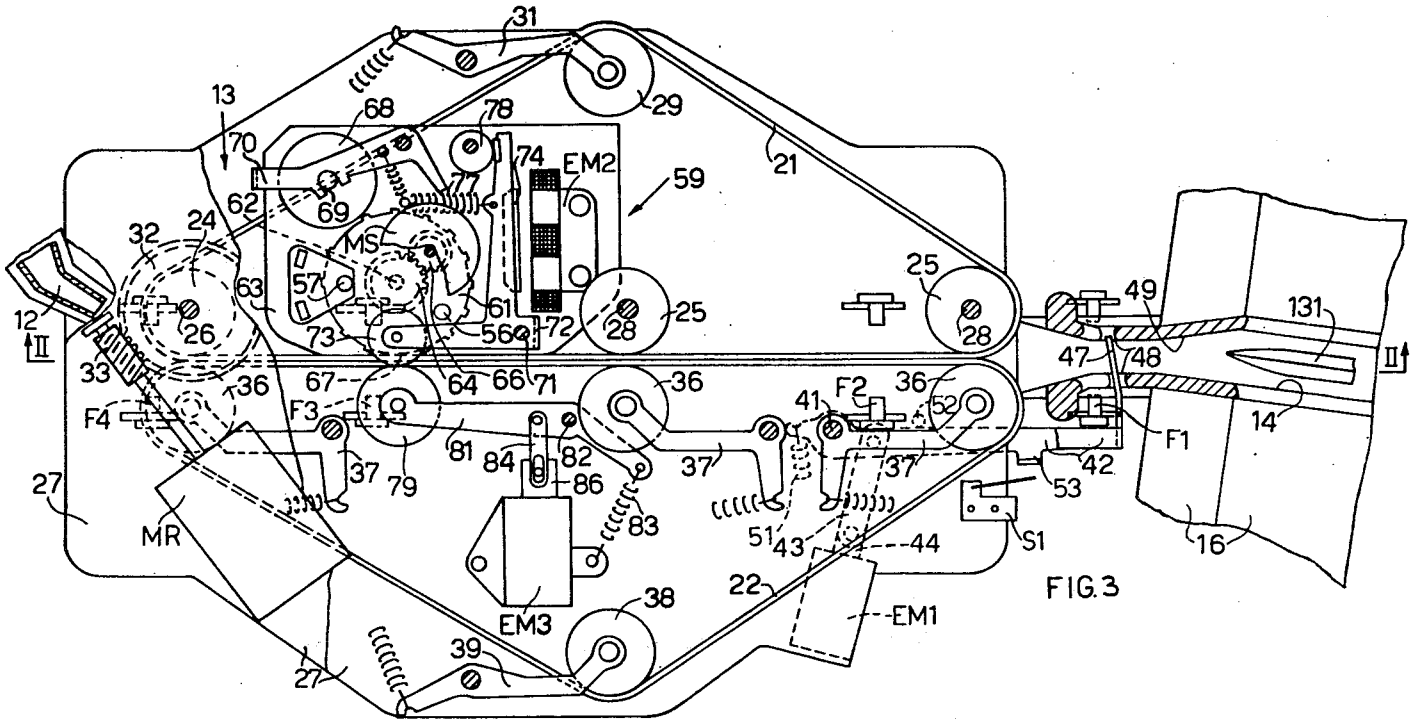
FIG. 3 is a partial horizontal section of the apparatus of FIG. 1, on an enlarged scale.

There is now effected a poll 204 of the switch S1. If it is still open, then after the time out there is signalled an error E, whilst if it has remained closed there are performed two polls 206 and 207 of the photocells F1 and F2. As long as F1 is not obscured or F2 is not illuminated the envelope 90 is still in transit and the two polls are repeated during the time out. If on the other hand there occurs the condition that F1 is obscured and F2 is again illuminated the envelope 90 has followed its proper path and is presented to the operator in the slit 14 (FIG. 3). There is now performed an operation 208 (FIG. 7) in which the circuit MRU is de-energised and therefore the motor MR is shut down (FIG. 3). In addition the electromagnet EM3 is de-energised and this now allows the spring 83 to carry the rollers 79 into contact with the rollers 73.

The microprocessor 186 (FIG. 6) now fixes a second time out, during which the envelope 90 must be withdrawn (operation 209) after which it controls a further poll 210 of the photocell F1. If the envelope 90 has been withdrawn the photocell F1 is illuminated and the microprocessor controls the de-energisation of the electromagnet EM1 (operation 211) so that the duct 49 (FIG. 1) becomes reclosed by the crosspiece 47. If, on the other hand the envelope 90 has not been withdrawn after the time determined by the operation 209, the positive result of a time out poll 212 generates a command for withdrawal of the envelope without printing (routine 213) which will be seen below.

If the operator enters on the keyboard 10 (FIG. 6) a deposit command, he must also declare if he requires deposit with printing of the envelope or else deposit without printing. The entire command message is sent to the control unit 20 which now passes to the microprocessor 186 a message which recalls the deposit programme from the ROM, whilst it sets a switch which indicates whether printing has been requested or not. First of all the microprocessor 186 performs a polling 214 (FIG. 8) of this switch. If printing has been requested a routine 216 is performed which controls inking and synchronisation of the character wheel 61 (FIG. 3). For this purpose the motor MS is put into rotation in such a way as to make the wheel 61 perform at least one revolution so that the characters are inked by the roller 68. If the element 56, which indicates the rest position of the wheel 61, passes the sensor 57 twice consecutively this indicates that the wheel 51 has performed at least one revolution and causes the motor MS to stop at the said rest position.

Subsequently, the microprocessor 186 (FIG. 6) controls energization of the electromagnet EM1 (operation 217 in FIG. 8), so that the lever 42 (FIG. 1) is turned and opens the duct 49 to allow the insertion of a full envelope 131 into the slit 14. When such opening has occurred the switch S1 is closed. After this the microprocessor 186 (FIG. 6) sets a suitable time out within the envelope must be introduced (operation 218 in FIG. 8) after which there follows a poll 219 to establish if the switch S1 has been closed and a poll 221 to establish if the envelope has obscured the photocell F1. If the result of one or the other of the two polls is negative there is performed a further time out poll 222 which causes the polls 219 and 221 to be repeated so that they do not generate an error signal E to shut down the apparatus as seen before. If, on the other hand, the two polls 219 and 221 give positive results an operation 223 is performed, by means of which the microprocessor 186 (FIG. 6), via the driven unit 196, causes energization of the circuit MRD in such a way as to make the motor MR (FIG. 3) rotate at high speed in a direction such as to convey the envelope 131 rapidly into the conveyor 13. Further, the microprocessor 186 (FIG. 6) causes energization of the electromagnet EM3 (operation 223 in FIG. 8) which spaces the roller 79 (FIG. 3) from the rollers 73. Now a series of polls, indicated 226 in FIG. 8, are performed to establish if the envelope 131 (FIG. 3) passes correctly across the photocells F1 and F2 and to establish if the length of the envelope 131 is within the limits. If the result of the polls 226 (FIG. 8) is positive there is performed another poll 227 for establishing if the photocell F3 is obscured. A negative result of polls 226 and 227 after the associated time out (poll 225) indicates an error.

If, on the other hand, the result of the poll 227 is positive, an operation 228 is performed which, on the one hand causes de-energization of the electromagnet EM3 (FIG. 3) so that the roller 79 presses the envelope 131 against the rollers 73, and on the other hand de-energises the electromagnet EM1 so that the duct 49 (FIG. 1) is reclosed. Meanwhile the microprocessor 186 (FIG. 6) effects sampling 229 (FIG. 8) of the switch indicative of the printing requests. If the result of this sampling is positive, an operation 231 is performed by means of which the unit 192 (FIG. 6) causes energization of the circuit MRD in such a way as to make the motor MR (FIG. 3) rotate at slow speed. This speed is proportional to the speed of the stepping motor MS and is such as to allow advance of the envelope 131 by one character pitch in the time that the motor MS takes to perform a complete revolution of the character wheel 61. A printing routine, indicated 232 in FIG. 8, has now begun, by means of which there is printed in series on the envelope 131 a message transmitted from the central unit 20 (FIG. 6) to the microprocessor 186. In particular, for each character the motor MS (FIG. 3) turns by a corresponding number of steps with respect to the preceding position, thus selectively positioning the wheel 61 with the desired character on the printing point 67. After a predetermined time, equal to one rotation of the wheel 61, the microprocessor 186 causes excitation of the electromagnet EM2 which causes the bridge 72 to turn, temporarily separating the rollers 73 from the envelope. This is now carried into contact with the wheel 61 so as to effect printing by the pressure exerted by the spring 83. Shortly afterwards the electromagnet EM2 is de-energised and the motor MS again caused to rotate to select the next character. Obviously, to pass from one character to the next, the wheel 61 generally performs a rotation less than 360°. However, when the same character is to be printed repeatedly, the wheel 61 still performs a complete revolution each time so that its inking by means of the roller 68 is ensured.

At the end of the printing routine 232 (FIG. 8) the circuit MRD is again energised to rotate the motor MR at high speed (operation 233) so that the envelope 131 is rapidly advanced towards the hopper 19 (FIG. 2). A poll 234 (FIG. 8) is now performed to establish if the envelope 131 has cleared the photocell F3. When this is illuminated the microprocessor 186 controls an operation 236 to drive the motor M2 which drives the rollers 141 and 142 (FIG. 2) of the drawer 17. A poll 237 (FIG. 8) is now performed to establish if the envelope has cleared the photocell F4. If this is affirmative the microprocessor 186 performs an operation 238 which causes de-energization of the circuit MRD so that the motor MR (FIG. 3), and therefore also the conveyor 13 is stopped.

The envelope 131 falls into the duct 18 (FIG. 5) and arrives first in front of the photodiode F5 and then onto the rollers 141 and 142 without rotation. The rollers 141 and 142 thus cause the envelope 131 to enter the drawer 17 and to become deflected to the bottom by the plate 160. Meanwhile the microprocessor 186 performs a pair of polls 239 and 240 (FIG. 8) to establish if the envelope has passed in front of the photocell F5. In the case of a positive result there is then performed an operation 241 which stops the motor M2 and after a predetermined time, in the absence of other deposits, the control unit 20 causes the vandal-proof roller shutter to close, and the apparatus is returned to its rest state.

When the operator commands a deposit without printing, the poll 214 gives a negative result and the operation 217 is immediately performed. This is also performed immediately in the event of failure of the client to withdraw the empty envelope (withdrawal routine 213 of FIG. 7). The negative result of the poll 229 is instead followed by a delay operation 242 after which the poll 234 of the photodiode F3 follows so that the envelope 131 is rapidly conveyed onto the duct 19 as in the preceding case.

To withdraw the drawer 17 (FIG. 2) from the safe 133, the employee opens the door 135 of the safe 133 and draws out the drawer 17 by the handle 132 (FIG. 1). The toothed ring 147 now becomes disengaged from the toothed ring 148 of the motor M2. The hook 179, by engaging the pin 178, causes the bridge 169 to turn in an anti-clockwise sense so that the projection 168 engages the arm 167 of the bridge 163 (FIG. 5). This thus becomes rotated in an anti-clockwise sense freeing the bridge 158 from the hook 164. The bridge 158 is thus rotated in an anticlockwise sense and locks the shaft 149 in the end-of-path position of FIG. 5, so that the two rollers 141 and 142 close the aperture 138 of the cover 136 of the drawer 17, preventing the removal of the envelopes during transport. Upon continued withdrawal of the drawer 17, the pin 178 (FIG. 2) causes the lever 180 to rotate in such a way as to release the hook 179 from the pin 178.

When the drawer 17 is opened and emptied by the authorised person, this manually reopens the security mechanism. For this purpose, by acting on the two hook ends 161 (FIG. 5) the bridge 159 is re-hooked onto the hook 164. The empty drawer 17 can now be re-inserted into its seat. The pin 178 of the bridge 169 engages the inclined back of the hook 179 overcoming the action of the spring 196 so that the lever 180 snaps into the locking position of FIG. 1. The insertion of the drawer 17 obviously does not affect the bridge 163. If the drawer 17 is not fully inserted the switch S3 is not closed and indicates, by means of the microprocessor 186, to the unit 20 and therefore, by means of the display 9 to the operator, the improper positioning of the drawer 17. From the above operation it is evident that the apparatus can operate completely unattended by any bank person.

It is understood that the apparatus described can be modified and improved without departing from the scope of the invention. For example, the programme of the microprocessor can provide a series of instructions to indicate to the operator the cause of any stoppage, indicated in the diagrams of FIGS. 7 and 8 by the signal E.

We claim:

1. An apparatus for depositing valuables in envelopes, with automatic dispensing of envelopes, in which the envelopes to be deposited are inserted into a slot of the apparatus and conveyed into an internal drawer of the apparatus, comprising a magazine within the apparatus containing the empty envelopes, a conveyor for individually moving the envelopes, said conveyor including at least one pair of belts in contact with one another along a predetermined path between the slot and an internal deflection station, a reversible electric motor operable for selectively driving the belts in a first direction to dispense an envelope from the magazine to the slot and in a second direction to convey an envelope inserted in the slot toward the drawer, said magazine including a duct leading to the deflection station, the duct being disposed in such a way that an envelope coming from the conveyor does not enter it.

2. Apparatus according to claim 1, wherein said magazine includes an envelope separating device (97) and an envelope pressure plate for resiliently pressing the envelopes towards the envelope separating device, the pressure plate cooperating with a sensor for providing an external indication of the absence of envelopes.

3. Apparatus according to claim 1, characterised by a slot closure element operable to open the slot under the control of a device for sensing an envelope coming from the magazine, the closure element being also controllable by an envelope deposit command.

4. Apparatus according to claim 1, characterised in that the deposit drawer is provided with an access slot, drive means being arranged over the slot for forcing an envelope coming from the conveyor into the drawer through a duct.

5. An unattended bank apparatus for depositing bank notes inserted into envelopes, including a front panel carrying a command keyboard and a slot for inserting into the apparatus an envelope to be deposited, a drawer internal to the apparatus and associated with access means for receiving the deposited envelopes, a magazine internal to the apparatus for containing a stack of empty envelopes, exit means on said magazine adjacent said access means for allowing the dispensing of the empty envelopes from the magazine, and a conveyor for said envelopes including at least one pair of belts in contact with each other along a predetermined path between said slot and a position substantially intermediate to said access means and said exit means, said belts being selectively operable in response to a first command from said keyboard for being driven in a first direction to convey the dispensed envelope from said exit means to said slot and in response to another command from said keyboard for being driven in a second direction to convey an envelope inserted into said slot toward said access means, said exit means being so shaped that an envelope coming from the conveyor does not enter it.

6. Apparatus according to claim 5, including a reversible electric motor for driving said belts selectively in one of the two opposite directions, and a printing device located along the envelope path for printing data character by character serial on an envelope in transit for deposit, the reversible motor being operable during the printing at a speed proportional to the spacing of the printing.

7. Apparatus according to claim 5, including a central control unit connected to said keyboard for control of the operations in dependence on manual commands, characterized by a microprocessor connected with said control unit able to receive a message on operations to be performed from the control unit and to control the performance of the individual operations of the apparatus in a predetermined sequence.

8. Apparatus according to claim 7, characterized by a plurality of sensors for detecting the passage of an envelope along the conveyor, the microprocessor being operable to coordinate the individual operations in response to signals from the sensors, independently of the length of the envelopes to be deposited.

9. An unattended bank apparatus for depositing banknotes inserted into envelopes, including a front panel carrying a command keyboard and an insertion slot for inserting into the apparatus an envelope to be deposited, an armoured housing internal to the apparatus and provided with an access aperture, a closed drawer removably housed in said housing an operable cover on said drawer provided with an entrance slot in correspondence with said access aperture, a conveyor operable in response to a command from said keyboard for conveying an envelope inserted into said insertion slot toward said aperture, drive means mounted on said drawer over said entrance slot and including a pair of rollers rotatable in mutually opposite directions, said rollers being yieldably in contact to each other for preventing access into said drawer, said drive means including also an electric motor disposed in the housing and engageable with a drive shaft for the rollers projecting out from the drawer, said electric motor being operable when an envelope arrives from said conveyor for causing said rollers to force said envelope into said drawer, one of said rollers being displaceable with respect to the other parallel to itself, and a locking mechanism operable to lock the displaceable roller in contact with the other roller when the drawer is removed from the housing.

10. Apparatus according to claim 9, wherein said entrance slot is disposed on an openable cover of the drawer and wherein the drive means include a pair of rollers which are rotatable in opposite senses, one of the rollers being displaceable with respect to the other parallel to itself.

11. Apparatus according to claim 9, wherein the rollers are driven by said electric motor are driven by an electric motor via a series of constantly meshing gears, the displaceable roller being mounted on a lever coaxial with a gear of the said series engaged by another gear rigidly connected to the roller.

12. Apparatus according to claim 9, characterised in that the locking mechanism includes a roller locking element which is normally inactivated by a hook located in the drawer, release means being disposed in the housing for operating the hook in such a way as to cause locking of the locking element during withdrawal movement of the drawer.

13. Apparatus according to claim 12, characterised in that the locking element can be manually re-engaged on the hook after having opened the cover by means of a lock the release means being inoperable on the hook during the re-insertion movement of the drawer.

* * * * *